US006755111B2

(12) United States Patent
Ciappi

(10) Patent No.: US 6,755,111 B2
(45) Date of Patent: Jun. 29, 2004

(54) MISSILE LAUNCHER CELL WITH EXHAUST GAS UPTAKE DUCTS, AND ARRAY OF SUCH MISSILE LAUNCHER CELLS

(75) Inventor: Jorge Ignacio Ciappi, Bel Air, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/892,839

(22) Filed: Jun. 27, 2001

(65) Prior Publication Data

US 2003/0000371 A1 Jan. 2, 2003

(51) Int. Cl.[7] ..... F41F 3/077

(52) U.S. Cl. ..... 89/1.817; 89/1.804

(58) Field of Search ..... 89/1.804, 1.806, 89/1.817

(56) References Cited

U.S. PATENT DOCUMENTS 3,072,022 A * 1/1963 Wood et al. ..... 89/1.7
3,135,162 A * 6/1964 Kamalian
3,499,364 A * 3/1970 D'Ooge ..... 89/1.81
5,837,917 A * 11/1998 Macnab et al. ..... 89/1.8
6,230,604 B1 * 5/2001 Larson et al. ..... 89/1.817

FOREIGN PATENT DOCUMENTS

GB 2 124 741 A * 2/1984 ..... 89/1.817

* cited by examiner

*Primary Examiner*—Stephen M. Johnson
(74) *Attorney, Agent, or Firm*—William H. Meise; Mark A. Wurm

(57) ABSTRACT

An elongated missile launcher cell is structured to allow arraying into multiple-cell array. Each missile launcher cell of the array includes a support structure which accommodates a canisterized missile. Each cell also includes its own chimney and exhaust gas plenum, so that it may be used individually. Since each cell has its own missile exhaust capability, there is no need to keep one or more bays of a missile launcher array vacant to provide for venting of exhaust gases.

10 Claims, 5 Drawing Sheets

MISSILE LAUNCHER CELL WITH EXHAUST GAS UPTAKE DUCTS, AND ARRAY OF SUCH MISSILE LAUNCHER CELLS

FIELD OF THE INVENTION

This invention relates to launchers for canisterized missiles, and more particularly to such launchers which are intended for placement below a protective deck for generally vertical launch.

BACKGROUND OF THE INVENTION

Modern warships rely principally on missiles, rather than cannon, for their offensive and defensive armament. Thus, a warship may include a single automatic cannon, together with one or more batteries of missile launchers. A battery of missile launchers may include a single missile launcher array at the rear deck of the ship, and two similar arrays on the foredeck.

A cluster of missile launchers for use on a ship may be similar to that described in U.S. Pat. No. 5,837,917, issued Nov. 17, 1998 in the name of McNab et al. McNab et al. describe a structure providing five vertical bays or "sleeves" of five juxtaposed missile launcher locations, held in a line array by muzzle-end, breech-end, and intermediate frames. Each sleeve of the missile launcher array of McNab et al. includes a support lattice dimensioned to accommodate a canisterized missile. Protection against blast and environment is provided by a hard hatch assembly which includes a plurality of individually controllable or openable hatches, each of which covers the end of one of the sleeves of the array. The breech ends of the sleeves open into a plenum, which is cooled by a water supply system. Cleats are provided for fastening the plenum to the underlying structure. The missile canisters with which the McNab launchers are used include a frangible protective seal at the muzzle and breech ends, and also include a missile ready for launch, presumably together with an electrical interface for providing information to the missile, if necessary, and for initiating the launch sequence as a result of external command. In order to use the McNab structure, one or more of the sleeve doors or hatches is opened, and a canisterized missile is lowered thereinto. While not expressly stated, an umbilical is presumably used to connect the missile canister to a portion of the launch control system near the sleeve, so that the missile may be remotely controlled. When that missile is to be launched, the door or hatch associated therewith is opened, and the corresponding hatch of a further one of the sleeves, which does not contain a canisterized missile, is opened. Missile firing is then commanded, as a result of which the missile within its container fires, expelling exhaust gases into the plenum and emerging from the muzzle end of the canister, breaking both frangible seals as it does so. The exhaust gases entering the plenum from the missile are cooled by water injection, which lowers the temperature of the exhaust gases to thereby reduce the infrared (IR) signature, reduce erosion due to the gas temperature, and in so doing generate a large amount of steam. The mixed steam and exhaust gases are routed from the plenum to above-decks by way of the vacant sleeve with its open hatch, used as a chimney. If the support structure is a lattice, as McNab illustrates, a protective sleeve may run within that vacant one of the sleeves which is used as a chimney for exhaust gases/steam. The protective sleeve may include ablatable material for further protection.

Improved missile launchers are desired.

SUMMARY OF THE INVENTION

A missile launcher cell according to an aspect of the invention is for accepting a canisterized missile which defines a missile launch end and a missile exhaust end, for, in use prior to missile launch, holding the missile canister in a generally vertical launch position below a deck. The missile launcher cell comprises at least one elongated exhaust gas chimney. It also comprises a support structure defining a generally axial cavity, also defining a missile launch end and a missile exhaust end. The cavity of the support structure has length and cross-sectional dimensions sufficient to accommodate the missile canister. The one or more exhaust chimneys lie along the exterior of the support structure and extend, parallel with the axis of the cavity, from near the missile launch end to near the missile exhaust end of the support structure. The missile launcher cell also includes a missile exhaust plenum attached to the support structure near the missile exhaust end of the support structure. The missile exhaust plenum is coupled to the one or more exhaust chimneys near the missile exhaust end of the support structure. The missile exhaust plenum further includes an attachment arrangement for attachment to the missile exhaust end of the missile canister, for routing missile exhaust gas from the missile exhaust end of the support structure to the one or more exhaust chimneys, for causing missile exhaust gas to vent from the one or more chimneys near the missile launch end of the support structure of the missile launcher cell. A door structure is attached to the missile launch end of the missile launch cell support structure, for, in the closed state, protecting at least the support structure, the one or more chimneys, and any missile canister accommodated within the cavity.

In a particular embodiment of the invention, the cavity has a rectangular, or more particularly square, cross-section, and is dimensioned to accommodate a Mk 25 canisterized missile. The support structure may be a latticework. The number of chimneys in a particular embodiment is two, with the two chimneys running parallel with each other and with the cavity axis.

In a particularly advantageous embodiment of the invention, an array of missile launcher cells has each of the missile launcher cells of the array dimensioned for accepting a canisterized missile, where each missile canister defines a missile launch end and a missile exhaust end. In use prior to missile launch, the array of missile launcher cells holds the missile canisters in a generally vertical launch position below a deck. Each of the missile launcher cells includes at least one elongated exhaust gas chimney, and a support structure defining a generally axial cavity defining a missile launch end and a missile exhaust end. The cavity of the support structure of each cell has length and cross-sectional dimensions sufficient to accommodate a missile canister. The one or more exhaust chimneys are attached, or lie adjacent to, the exterior of the support structure and extend, parallel with the axis of the cavity, from near the missile launch end to near the missile exhaust end of the structure. A missile exhaust plenum is attached to the support structure near the missile exhaust end of the support structure of each cell. The missile exhaust plenum of each cell is coupled to the one or more exhaust chimneys near the missile exhaust end of the support structure, and also includes an attachment arrangement or means for attachment to the missile exhaust end of the missile canister, for thereby routing missile exhaust gas from the missile exhaust end of the support structure to the one or more chimneys, for causing missile exhaust gas to vent from the at least one chimney near the missile launch end of the support structure. A door structure is attached to the missile launch end of the missile launch structure, for, when closed, protecting at least the support structure and the one or more exhaust chimneys of the missile launcher cell, and any missile canister accommodated within the cavity of the cell, and for, when open, providing for egress of the missile from its canister and exhaust gas from the one or more chimneys. This arrangement allows the array of missile launchers to be maintained in a condition in which all of the launcher cells are fitted with canisterized missiles, without keeping at least one missile launch cell clear or unloaded so as to provide a chimney or path for the escape of exhaust gas from a missile fired in a missile launch cell of the array. Thus, an aspect of the invention lies in an array of launchers in which a canisterized missile located within each of (all of) the cavities of the array.

BRIEF DESCRIPTION OF THE DRAWING

FIGS. 4*a*, 4*b*, and 4*c* are simplified side elevation and plan views, respectively, looking in mutually orthogonal directions, of the missile launcher cell of FIG. 2 with its hatch open, showing the individual exhaust gas management plenum, two exhaust gas chimneys or uptakes extending from the plenum to the muzzle or missile exit end of the launcher cell, and the door assemblage covering the missile launch exit and the chimneys;

DESCRIPTION OF THE INVENTION

Figure 1:
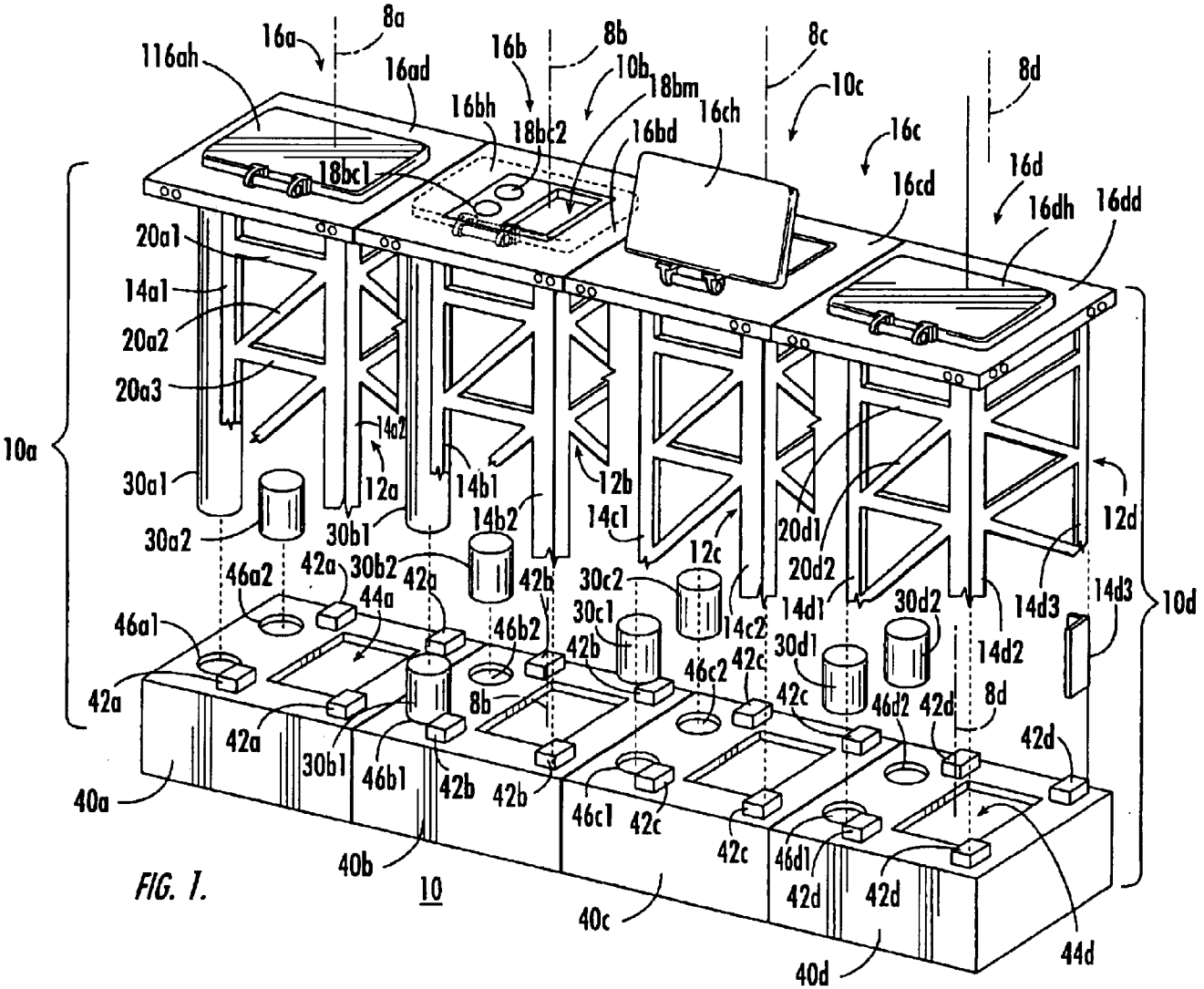
FIG. 1 is a simplified perspective or isometric view, partially cut away, of a representative array of four individual missile launcher cells according to an aspect of the invention.

FIG. 1 is a simplified perspective or isometric view of an array 10 of individual missile launcher cells 10*a*, 10*b*, 10*c*, and 10*d*, with portions of the structure cut away to reveal interior details. In FIG. 1, the individual cells 10*a*, 10*b*, 10*c*, and 10*d* are identical to each other. Each cell includes a lattice-type support structure designated 12, thus missile launcher 10*a* includes a lattice-type support structure designated 12*a*, missile launcher cell 10*b* includes a lattice-type support structure 12*b*, missile launcher cell 10*c* includes a lattice-type support structure 12*c*, and launcher cell 10*d* includes a lattice-type support structure 12*d*. Each support structure 12 includes four "leg" portions. Taking missile launcher cell 10*d* of FIG. 1 as being representative, three such legs can be seen, namely legs 14*d*1, 14*d*2, and 14*d*3, and the fourth leg is not illustrated. The illustrated legs of support structure 12*a* of missile launcher 10*a* are 14*a*1 and 14*a*2, the illustrated legs of support structure 12*b* of missile launcher 10*b* are 14*b*1 and 14*b*2, and the illustrated legs of support structure 12*c* of missile launcher 10*c* are 14*c*1 and 14*c*2. The legs of each support structure extend parallel with the missile launcher longitudinal axis; in particular, the various legs extend parallel to their corresponding launcher cell longitudinal axes 8*a*, 8*b*, 8*c*, and 8*d*.

A plurality of interconnecting support braces extend between the "legs" of the support structure of each missile launcher cell. As illustrated in FIG. 1, representative support braces 20*a*1, 20*a*2, and 20*a*3 extend between leg elements 14*a*1 and 14*a*2.

The combination of these leg elements and support braces defines an elongated cavity (not clearly visible in FIG. 1), having a rectangular or square cross-section, which extends vertically through each support structure 12*a*, 12*b*, 12*c*, and 12*d*. The cross-sectional dimensions of each such cavity are dimensioned to accommodate a canisterized missile, and to hold such canisterized missile in a vertical or about-vertical posture. In a particular embodiment in which the canisterized missile is a Mark 25 canisterized missile, the cross-section is square.

A protective door or hatch assembly or structure is located at the upper or missile launch end of each missile launcher cell. More particularly, FIG. 1 illustrates a hatch assembly 16*a* associated with missile launcher cell 10*a*, a hatch assembly 16*b* associated with missile launcher cell 10*b*, a hatch assembly 16*c* associated with missile launcher cell 10*c*, and a hatch assembly 16*d* associated with missile launcher cell 10*d*. Each hatch assembly includes a generally flat deck portion or deck extension, and a hatch covering one or more apertures by which one or more missiles may exit, and or through which exhaust gases may vent. In FIG. 1, hatch assembly 16*a* of missile launcher cell 10*a* has a deck portion of deck extension 16*ad* and a hinged hatch 16*ah*, hatch assembly 16*d* of missile launcher cell 10*d* has a deck 16*dd* and a hinged hatch 16*dh*, with the hatches illustrated as being in the closed position. Hatch assembly 16*c* of missile launcher 16*c* has a deck 16*cd* and an open hatch 16*ch*. The hatch 16*bh* of hatch assembly 16*b* is illustrated in phantom to reveal a square missile-end "aperture" 18*bm* in which a canisterized missile (not illustrated in FIG. 1) may be accommodated, and additional chimney or exhaust uptake apertures 18*bc*1 and 18*bc*2.

Each missile launcher cell 10*a*, 10*b*, 10*c*, and 10*d* of array 10 of FIG. 1 also includes an a pair of missile exhaust gas uptake ducts or chimneys. In FIG. 1, portions of the two chimneys associated with missile launcher cell 10*a* are designated 30*a*1 and 30*a*2, and portions of the corresponding chimneys of missile launcher cell 10*b* are designated 30*b*1 and 30*b*2, respectively. The chimneys associated with missile launcher cell 10*c* are designated 30*c*1 and 30*d*2, and those associated with missile launcher cell 10*d* are designated 30*d*1 and 30*d*2 in FIG. 1. The chimneys associated with each launcher cell extend from near the bottom, breech or missile exhaust end of each launcher cell to near the top, muzzle, or missile launch end of the launcher cell, and are generally parallel with the axis of the corresponding support structure. Thus, chimneys 30*a*1 and 30*a*2 extend parallel with the longitudinal axis 8*a* of missile launcher support structure 12*a*, chimneys 30*b*1 and 30*b*2 extend parallel with the longitudinal axis 8*b* of missile launcher support structure 12*b*, chimneys 30*c*1 and 30*c*2 extend parallel with the longitudinal axis 8*c* of missile launcher support structure 12*c*, chimneys 30*d*1 and 30*d*2 extend parallel with the longitudinal axis 8*d* of missile launcher support structure 12*d*. At their upper ends, the various chimneys or missile exhaust gas uptake ducts open into a region which lies under the doors or hatches of the corresponding missile launcher cell when that door or hatch is in its closed position. In FIG. 1, the open ends of the two chimneys 30*b*1 and 30*b*2 are designated 18*bc*1 and 18*bc*2, respectively. The chimneys are preferably fastened to the corresponding deck plate, as by welding if the chimney is metallic, or by other suitable fastening method for other materials, as for example the chimneys 30*b*1 and 30*b*2 should be secured to deck plate 16*bd*. The corresponding hatch 16*bh*, when in its closed state, covers both the two chimney openings 18*bc*1 and 18*bc*2 and also the upper end of the elongated, vertically oriented cavity associated with or defined by the support structure 12*b*.

In addition to the chimneys, each missile launcher cell 10*a*, 10*b*, 10*c*, and 10*d* of array 10 is associated with an exhaust gas plenum or manifold. Thus, a plenum 40*a* is associated with missile launcher cell 10*a*, a plenum 40*b* is associated with missile launcher cell 10*b*, a plenum 40*c* is associated with missile launcher cell 10*c*, and a plenum 40*d* is associated with missile launcher cell 10*d*. Each exhaust gas plenum includes an attachment arrangement for attaching the plenum to the support structure. In a particular embodiment of the invention, the attachment arrangement also supports a "dogdown" arrangement which provides secure attachment of the plenum to the lower end of the canister of the canisterized missile used therewith. In FIG. 1, the attachment arrangement for the exhaust gas plenum of each missile launcher includes four bosses or structures of a set 42 of bosses. Thus, exhaust gas plenum 40*a* of FIG. 1 includes on its upper surface four attachment bosses, each of which is designated 42*a*, spaced around a rectangular or square exhaust gas inlet port 44*a*. Similarly, exhaust gas plenum 40*b* includes on its upper surface four attachment bosses, each of which is designated 42*b*, spaced around a square exhaust gas inlet port 44*b*, exhaust gas plenum 40*c* includes on its upper surface four attachment bosses, each of which is designated 42*c*, spaced around a square exhaust gas inlet port 44*c*, and exhaust gas plenum 40*d* includes on its upper surface four attachment bosses, each of which is designated 42*d*, spaced around a square exhaust gas inlet port 44*d*. Each of the bosses of set 42 is attached to the lower end of a leg of the associated support structure. As an example, the lower ends of the three vertically disposed legs 14*d*1, 14*d*2, and 14*d*3 of support structure 12*d* of missile launcher 10*d* which are visible in FIG. 1 are attached to those three bosses 42*d* of plenum 40*d* which are nearest the viewer. This effectively fastens the plenum 40*d* to its associated support structure 12*d*, with axis 8*d* of the elongated vertically-oriented cavity (not designated in FIG. 1) associated with the support structure 12*d* overlying the missile exhaust gas entry port 44*d* of the plenum 40*d*.

The chimneys or missile exhaust gas uptake ducts of each missile launcher cell are connected at their lower, missile exhaust, or breech ends to corresponding apertures of the associated plenum, so that missile exhaust gases entering the plenum can be vented through the chimneys to a location near the upper, missile launch, or muzzle ends of the structure. More particularly, the lower ends of chimneys 30*a*1 and 30*a*2 of missile launcher 10*a* are connected to corresponding apertures 46*a*1 and 46*a*2 of plenum 40*a*, the lower ends of chimneys 30*b*1 and 30*b*2 of missile launcher lob are connected to corresponding apertures 46*b*1 and 46*b*2 of plenum 40*b*, the lower ends of chimneys 30*c*1 and 30*c*2 of missile launcher 10*c* are connected to corresponding apertures 46*c*1 and 46*c*2 of plenum 40*c*, and the lower ends of chimneys 30*d*1 and 30*d*2 of missile launcher 10*d* are connected to corresponding apertures 46*d*1 and 46*d*2 of plenum 40*d*. The chimneys are thus supported at their lower ends by attachment to their respective plenums, and may be attached at their upper ends to their respective deck plates. In addition, further attachments may be made along their lengths to their respective support structures.

Figure 2:
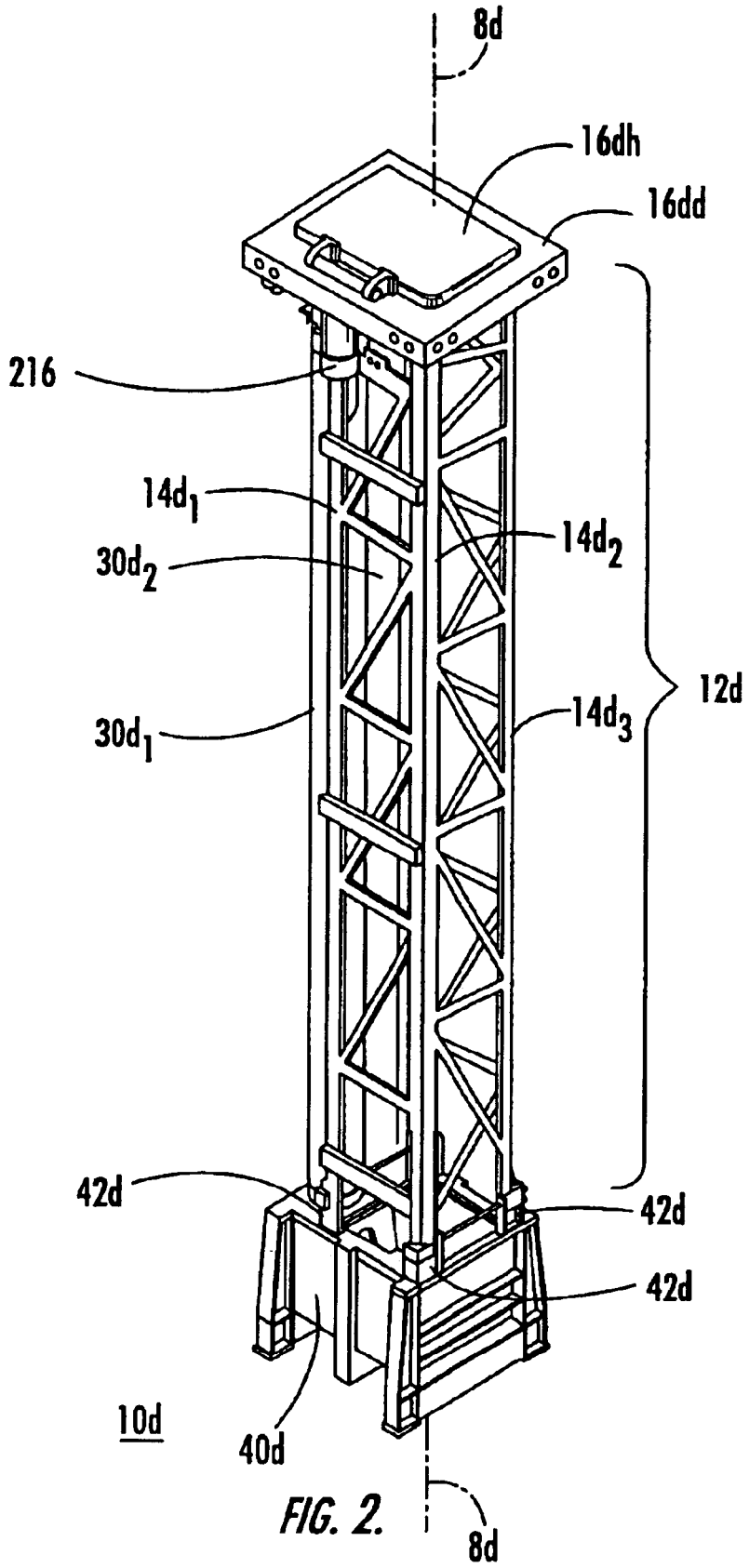
FIG. 2 is a simplified perspective or isometric view of a single missile launcher cell of FIG. 1.
Figure 3A:
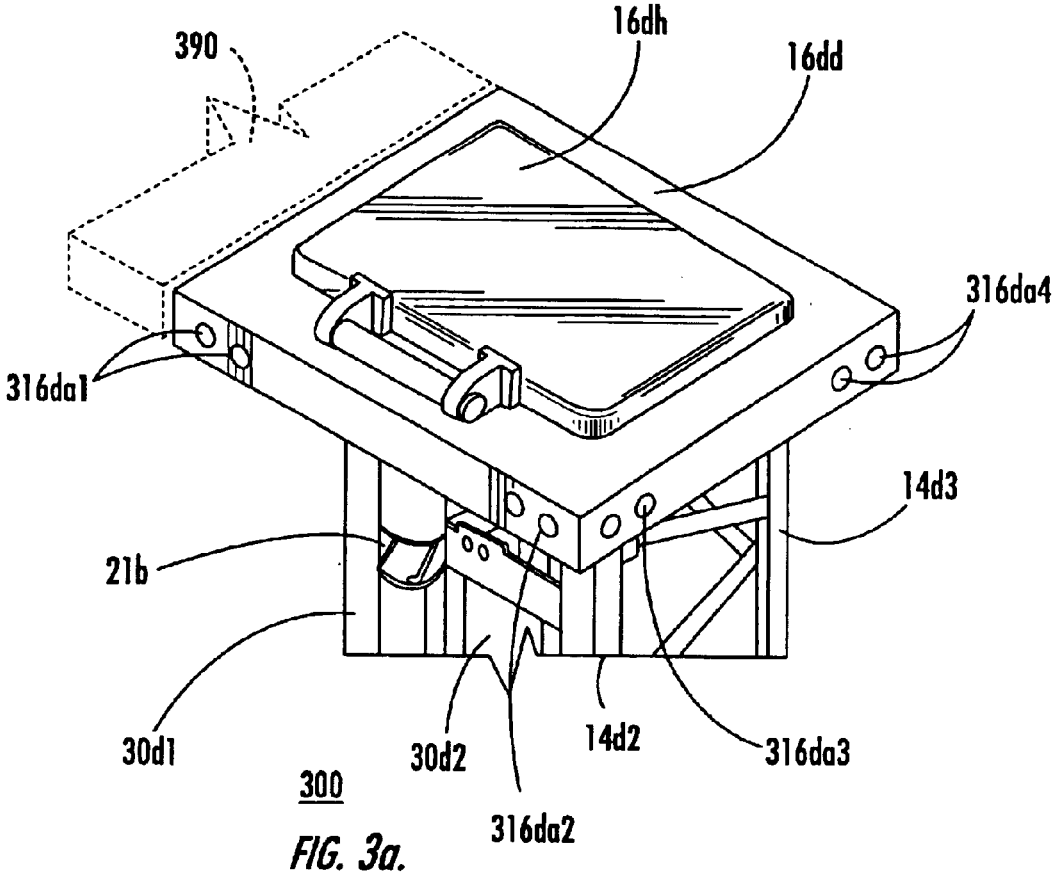
FIG. 3*a* is a simplified perspective or isometric view illustrating details of the deck portion and hatch near the missile launch end of the missile launcher cell of FIG. 2.

FIG. 2 is a simplified perspective or isometric view of missile launcher cell 10*d* of FIG. 1, standing alone. Elements of FIG. 2 corresponding to those of FIG. 1 are designated by the same reference numerals. In FIG. 2, A portion of the drive mechanism which controls the operation of hatch 16*dh* is designated as 216. FIG. 3*a* is a simplified perspective or isometric view of the upper, missile launch, or muzzle end 300 of the missile launcher cell 10*d* of FIG. 2. In FIG. 3*a*, elements corresponding to those of FIG. 2 are designated by the same reference numerals. In FIG. 3*a*, various sets of apertures or holes defined in the edge of the deck portion 16*dd* are designated 316*da*1, 316*da*2, 316*da*3, and 316*da*4. These sets of apertures are provided for allowing the use of bolts to fasten each deck portion to an adjacent deck portion of another missile launcher cell, in order to form an array such as that illustrated and described in conjunction with FIG. 1, or to fasten the deck portion of the cell to an adjacent deck structure of the ship or other support structure on which it is mounted, a cut-away portion of which is illustrated in phantom as 390 in FIG. 3*a*.

Figure 3B:
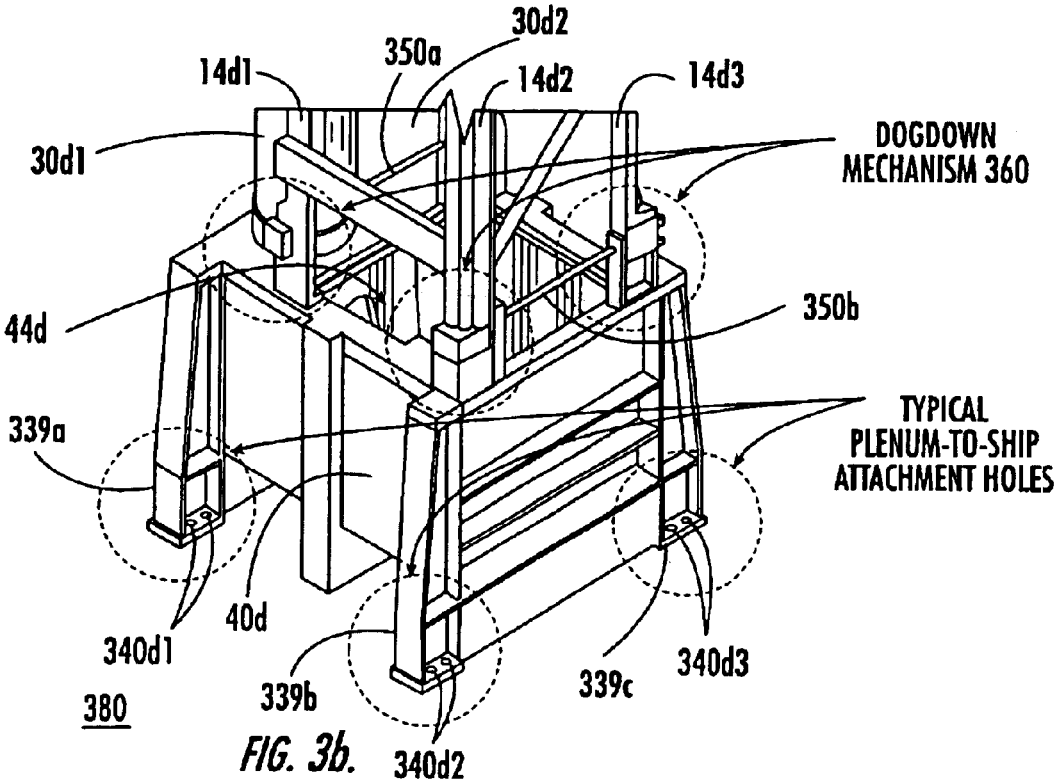
FIG. 3*b* is a corresponding detail of the missile exhaust plenum near the missile exhaust end of the missile launcher cell of FIG. 2.

FIG. 3*b* is a simplified perspective or isometric view of a lower, missile exhaust end, or breech end 380 of the missile launcher structure of FIG. 2, illustrating some details of the structure. Elements of FIG. 3*b* corresponding to those of FIG. 2 are designated by like reference numerals. In FIG. 3*b*, the structure of plenum 40*d* is seen to include legs or supports 339*a*, 339*b*, and 339*c*, each of which defines a plurality of plenum-to-ship mounting or attachment holes or apertures 340*d*1, 340*d*2, and 340*d*3, respectively. In addition, details of the dogdown mechanism 360 include connecting drive bars 350*a* and 350*b*.

Figures 4A, 4B:
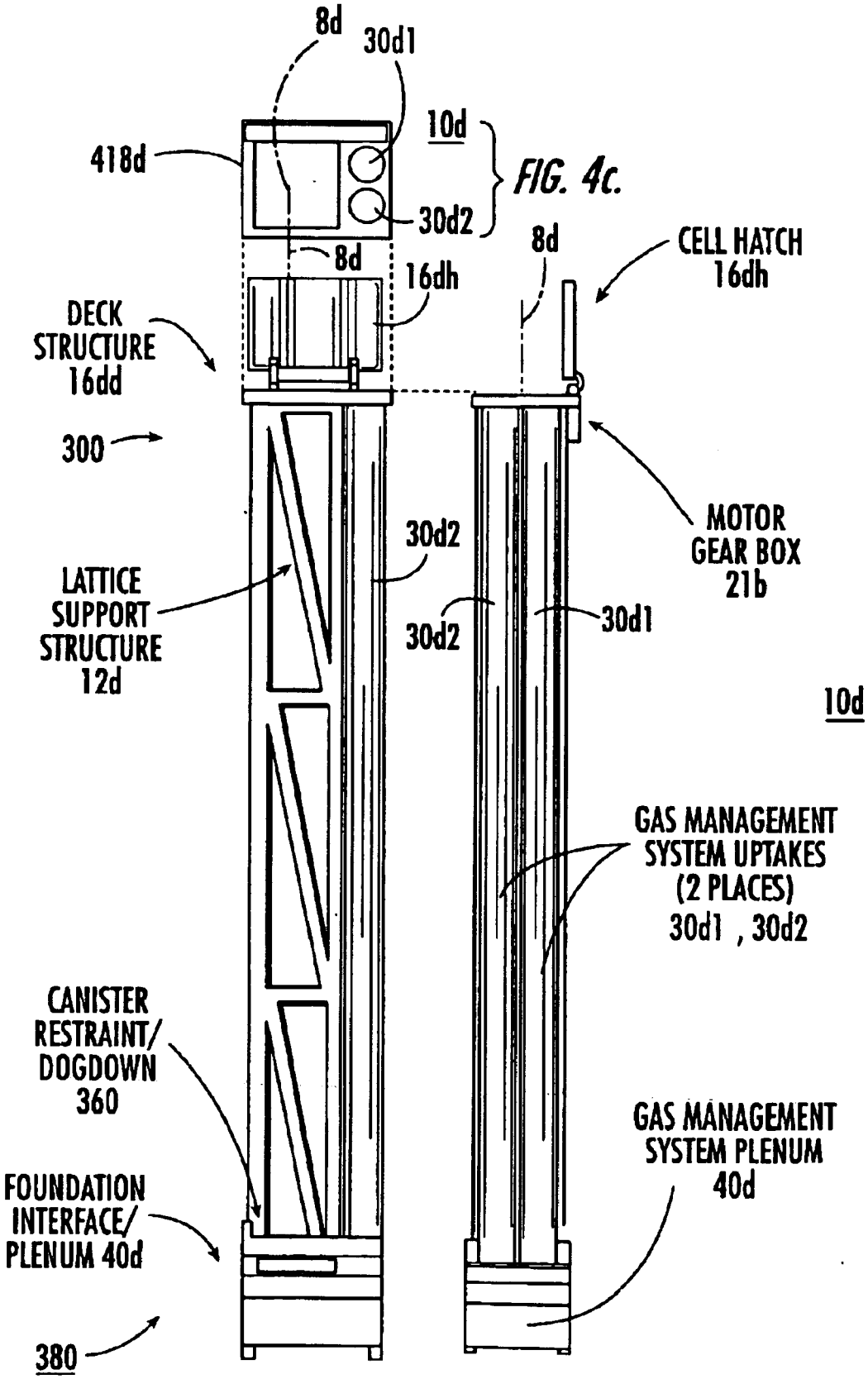

In FIGS. 4*a*, 4*b*, and 4*c*, elements corresponding to those of FIGS. 1, 2, 3*a*, and 3*b* are designated by the same reference numerals. In FIG. 4*c*, the aperture 418*d* represents the end of the elongated cavity defined by the support structure 12*d*, and it is centered on axis 8*d*, which appears as a dot in the view of FIG. 4*c*. FIG. 4*b* illustrates axis 8*d* as centered in the view, while FIG. 4*a* shows axis 8*d* as off-center relative to the entire structure. Axis 8*d* appears as off center in FIG. 4*a* because it is centered on the support structure 12*d*, which is offset relative to the entire missile launcher cell 10*d* because of the presence of the chimneys 30*d*1 and 30*d*2.

Figure 5:
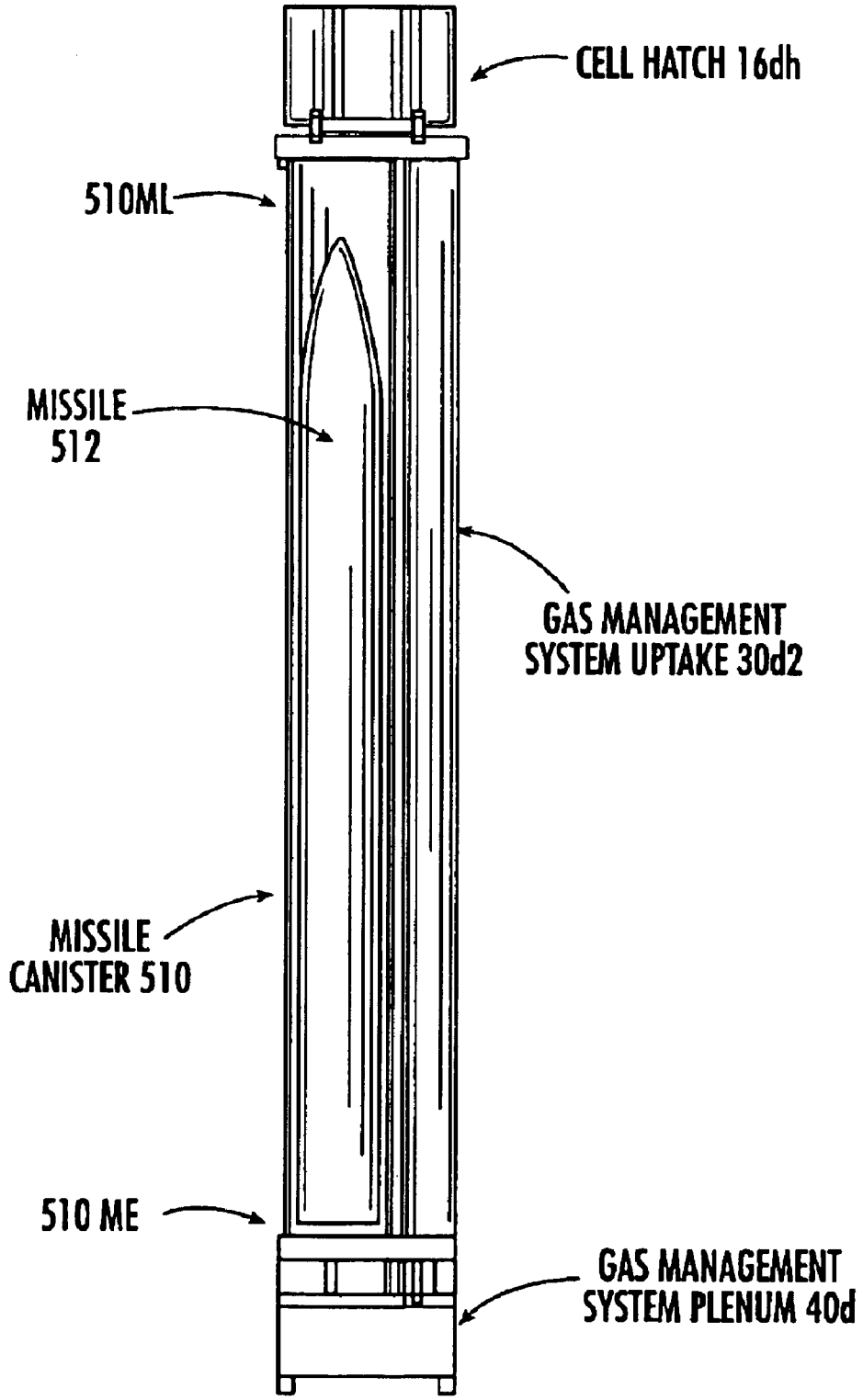
FIG. 5 is a simplified cross-sectional elevation view of the single missile launcher of FIG. 2, showing the location of the missile within the missile canister and a portion of the gas management system, including the plenum and one chimney, and the deck door or hatch.

FIG. 5 represents a cross-sectional view of missile launcher cell 10*d* of FIG. 1 shown alone, and partially cut away to show the missile 512 and a missile canister 510, defining a missile launch end 510ML and a missile exhaust end 510ME, with the missile 512 contained within the canister 510. In FIG. 5, the hatch 16*dh* is open.

Other embodiments of the invention will be apparent to those skilled in the art. For example, while the support structure 12*x* of a cell 10*x* of the FIGURES are illustrated as being of a particular form of lattice, other types may be used, or solid (non-lattice) portions may be used. While the missile launcher array of FIG. 1 shows a linear array of missile launcher cells, the array can be rectangular, so that it includes a plurality of rows and columns, and it may intermix rectangular or square with linear arrays of missile launcher cells. While the plenum associated with each missile launch cell has been shown as being roughly cubical, it may be drum-shaped (that is, a portion of a right circular cylinder) or semispherical (some portion of a sphere, including a hemisphere). While the missile canister has been described as containing a single missile, the missile canister can be of the type containing a plurality of missiles.

Thus, a missile launcher cell (any one of 12*a*, 12*b*, 12*c*, or 12*d* of array 10, with 12*d* taken as typical) according to an aspect of the invention is for accepting a canisterized missile (510, 512) which defines a missile launch end (510ML) and a missile exhaust end (510ME), for, in use prior to missile launch, holding the missile canister (510, 512) in a generally vertical launch position below a deck (390). The missile launcher cell (16*d*) comprises at least one elongated exhaust gas chimney (30*d*1, 30*d*2). It also comprises a support structure (14*d*1, 14*d*2, 20*d*1, 20*d*2) defining a generally axial cavity (418*d*), also defining a missile launch end and a missile exhaust end. The cavity (418*d*) of the support structure (14*d*1, 14*d*2, 20*d*1, 20*d*2) has length and cross-sectional dimensions sufficient to accommodate the missile canister. The one or more exhaust chimneys (30*d*1, 30*d*2) lie along the exterior of the support structure (14*d*1, 14*d*2, 20*d*1, 20*d*2) and extend, parallel with the axis (8*d*) of the cavity (418*d*), from near the missile launch end (300) to near the missile exhaust end (380) of the support structure (14*d*1, 14*d*2, 20*d*1, 20*d*2). The missile launcher cell (16*d*) also includes a missile exhaust plenum (40*d*) attached to the support structure (14*d*1, 14*d*2, 20*d*1, 20*d*2) near the missile exhaust end (380) of the support structure (14*d*1, 14*d*2, 20*d*1, 20*d*2). The missile exhaust plenum (40*d*) is to the one or more exhaust chimneys (30*d*1, 30*d*2 ) near the missile exhaust end (380) of the support structure (14*d*1, 14*d*2, 20*d*1, 20*d*2). The missile exhaust plenum (40*d*) further includes an attachment arrangement (360) for attachment to the missile exhaust end (510ME) of the missile canister (510, 512), for routing missile exhaust gas from the missile exhaust end (380) of the support structure (14*d*1, 14*d*2, 20*d*1, 20*d*2) to the one or more exhaust chimneys (30*d*1, 30*d*2), for causing missile exhaust gas to vent from the one or more chimneys (30*d*1, 30*d*2) near the missile launch end (300) of the support structure (14*d*1, 14*d*2, 20*d*1, 20*d*2) of the missile launcher cell (16*d*). A door or hatch structure (16*dh*) is attached to the missile launch end (300) of the missile launch cell support structure (14*d*1, 14*d*2, 20d*1*, 20*d*2), for, in the closed state, protecting at least the support structure (14*d*1, 14*d*2, 20*d*1, 20*d*2), the one or more chimneys 30*d*1, 30*d*2) and any missile canister (510, 512) accommodated within the cavity (418*d*).

In a particular embodiment of the invention, the cavity (418) has a rectangular, or more particularly square, cross-section, and is dimensioned to accommodate a Mk 25 canisterized missile (510,512). The support structure (14*d*1, 14*d*2, 20*d*1, 20*d*2) may be a latticework. The number of chimneys (30*d*1, 30*d*2) in a particular embodiment is two, with the two chimneys (30*d*1, 30*d*2) running parallel with each other and with the cavity axis (8*d*).

In a particularly advantageous embodiment of the invention, an array (10) of missile launcher cells (16*a*, 16*b*, 16*c*, and 16*d*) has each of the missile launcher cells (16*d*) of the array dimensioned for accepting a canisterized missile (510, 512), where each missile canister (510, 512) defines a missile launch end (510ML) and a missile exhaust end (510ME). In use prior to missile launch, the array (10) of missile launcher cells (16*d*) holds the missile canisters (510, 512) in a generally vertical launch position below a deck. Each of the missile launcher cells (16*d*) includes at least one elongated exhaust gas chimney (30*d*1, 30*d*2), and a support structure (14*d*1, 14*d*2, 20*d*1, 20*d*2) defining a generally axial cavity (418*d*), and defining a missile launch end (300) and a missile exhaust end (380). The cavity (418*d*) of the support structure (14*d*1, 14*d*2, 20*d*1, 20*d*2) of each cell has length and cross-sectional dimensions sufficient to accommodate a missile canister (510, 512). The one or more exhaust chimneys (30*d*1, 30*d*2) are attached, andor lie adjacent to, the exterior of the support structure (14*d*1, 14*d*2, 20*d*1, 20*d*2) and extend, parallel with the axis (8*d*) of the cavity, from near the missile launch end (300) to near the missile exhaust end (380) of the structure. A missile exhaust plenum (40*d*) is attached to the support structure (14*d*1, 14*d*2, 20*d*1, 20*d*2) near the missile exhaust end (380) of the support structure (14*d*1, 14*d*2, 20*d*1, 20*d*2) of each cell. The missile exhaust plenum (40*d*) of each cell (16) is coupled to the one or more exhaust chimneys (30*d*1, 30*d*2) near the missile exhaust end (380) of the support structure (14*d*1, 14*d*2, 20*d*1, 20*d*2), and also includes an attachment arrangement or means for attachment (360) to the missile exhaust end (510ME) of the missile canister (510, 512), for thereby routing missile exhaust gas from the missile exhaust end (380) of the support structure (14*d*1, 14*d*2, 20*d*1, 20*d*2) to the one or more chimneys (30*d*1, 30*d*2), for causing missile exhaust gas to vent from the at least one chimney (30*d*1, 30*d*2) near the missile launch end (300) of the support structure (14*d*1, 14*d*2, 20*d*1, 20*d*2). A door or hatch structure (16*dh*) is attached to the missile launch end (300) of the missile launch support structure (14*d*1, 14*d*2, 20*d*1, 20*d*2), for, when closed, protecting at least the support structure (14*d*1, 14*d*2, 20*d*1, 20*d*2) and the one or more exhaust chimneys (30*d*1, 30*d*2) of the missile launcher cell (16*d*), and any missile canister (510, 512) accommodated within the cavity (418*d*) of the cell, and for, when open, providing for egress of the missile (512) from its canister (510) and exhaust gas from the one or more chimneys (30*d*1, 30*d*2). This arrangement allows the array of missile launchers to be maintained in a condition in which all of the launcher cells are fitted with canisterized missiles, without keeping at least one missile launch cell clear or unloaded so as to provide a chimney or path for the escape of exhaust gas from a missile fired in a missile launch cell of the array. Thus, an aspect of the invention lies in an array of launchers (10) in which a canisterized missile is located within each of (all of) the cavities of the array.

What is claimed is:

1. A missile launcher for accepting a canisterized missile, which missile canister defines a missile launch end and a missile exhaust end, for, prior to missile launch, holding said missile canister in a generally vertical launch position below a deck, said missile launcher comprising:

at least one elongated round exhaust gas chimney;

a support structure defining a generally axial cavity defining a missile launch end and a missile exhaust end, said cavity of said support structure having length and cross-sectional dimensions sufficient to accommodate said missile canister, said at least one elongated round exhaust gas chimney lying along the exterior of said support structure and extending, parallel with said axis of said cavity, from near said missile launch end to near said missile exhaust end;

a missile exhaust plenum attached near said missile exhaust end of said support structure, said missile exhaust plenum being coupled to said at least one elongated round exhaust gas chimney near said missile exhaust end of said support structure, said missile exhaust plenum further including attachment means for attachment to said missile exhaust end of said missile canister, for routing missile exhaust gas from said missile exhaust end of said support structure to said at least one elongated round exhaust gas chimney, for causing missile exhaust gas to vent from said at least one elongated round exhaust gas chimney near said missile launch end of said support structure; and a door structure attached to said missile launch end of said missile launch structure, for, when closed, protecting at least said support structure, said at least one elongated round exhaust gas chimney, and any missile canister accommodated within said cavity, and for, when open, providing clearance for launch of said missile, and for venting of said exhaust gas from said at least one elongated round exhaust gas chimney.

2. The missile launcher according to claim 1, wherein said cavity has a rectangular cross-section.

3. The missile launcher according to claim 2, wherein said rectangular cavity has a square cross-section.

4. The missile launcher according to claim 1, wherein said at least one elongated round exhaust gas chimney is two elongated round exhaust gas chimneys.

5. An array of missile launchers, each of said missile launchers of said array being adapted for accepting a canisterized missile, which missile canister defines a missile launch end and a missile exhaust end, each of said missile launchers being for, prior to missile launch, holding said missile canister in a generally vertical launch position below a deck, each of said missile launchers comprising:

at least one elongated round exhaust gas chimney;

a support structure defining a generally axial cavity defining a missile launch end and a missile exhaust end, said cavity of said support structure having length and cross-sectional dimensions sufficient to accommodate said missile canister, said at least one elongated round exhaust gas chimney lying adjacent the exterior of said support structure and extending, parallel with said axis of said cavity, from near said missile launch end to near said missile exhaust end;

a missile exhaust plenum attached to said support structure near said missile exhaust end of said support structure, said missile exhaust plenum being coupled to said at least one elongated round exhaust gas chimney near said missile exhaust end of said support structure, said missile exhaust plenum further including attachment means for attachment to said missile exhaust end of said missile canister, for routing missile exhaust gas from said missile exhaust end of said support structure to said at least one elongated round exhaust gas chimney, for causing missile exhaust gas to vent from said at least one elongated round exhaust gas chimney near said missile launch end of said support structure;

a door structure attached to said missile launch end of said missile launch structure, for, when closed, protecting at least said support structure, said at least one elongated round exhaust gas chimney, and any missile canister accommodated within said cavity, and for, when open, allowing egress of said missile and venting of said exhaust gas from said at least one elongated round exhaust gas chimney; and said array further comprising an attachment means coupled to each of said missile launchers of said array, for attaching said missile launchers to each other to form said array, and for attaching said array to an underlying structure.

6. A missile launcher for accepting a missile canister, which missile canister defines a missile launch end and a missile exhaust end, for, prior to missile launch, holding said missile canister in a generally vertical launch position below a deck, said missile launcher comprising:

at least one elongated round exhaust gas chimney;

a lattice support structure defining a generally axial cavity defining a missile launch end and a missile exhaust end, said cavity of said lattice support structure having length and cross-sectional dimensions sufficient to accommodate said missile canister, said at least one elongated round exhaust gas chimney lying adjacent the exterior of said support structure and extending from near said missile launch end to near said missile exhaust end of said support structure;

a missile exhaust plenum attached near said missile exhaust end of said support structure, said missile exhaust plenum being coupled to said at least one elongated round exhaust gas chimney near said missile exhaust end of said support structure, said missile exhaust plenum further including attachment means for attachment to said missile exhaust end of said missile canister, for routing missile exhaust gas from said missile exhaust end of said support structure to said at least one elongated round exhaust gas chimney, for thereby causing missile exhaust gas to vent from said at least one elongated round exhaust gas chimney near said missile launch end of said support structure; and a door structure attached to said missile launch end of said missile launch structure, for, when closed, protecting at least said lattice support structure, said at least one elongated round exhaust gas chimney, and any missile canister accommodated within said cavity, and for, when open, providing clearance for launch of that missile accommodated within a canister within said cavity, and for allowing egress of said exhaust gas from said at least one elongated round exhaust gas chimney.

7. The missile launcher according to claim 6, wherein the cross-section of said cavity is generally rectangular in cross-section.

8. The missile launcher according to claim 7, wherein said cavity is generally square in cross-section.

9. The missile launcher according to claim 6, wherein said at least one elongated round exhaust gas chimney comprises two mutually parallel exhaust chimneys of substantially equal length.

10. An array of missile launchers for accommodating and protecting a plurality of missile canisters, each of which missile canisters may include one or more missiles, and each of which missile canisters defines a missile launch end and a missile exhaust end, for, in use, accommodating said missile canisters in a generally vertical launch position below a deck, said array of missile launchers including a battery including a plurality of individual missile launchers, each of said individual missile launchers including:

at least one elongated round exhaust gas chimney;

a lattice support structure defining a generally axial cavity defining a missile launch end and a missile exhaust end, said cavity of said lattice support structure having length and cross-sectional dimensions sufficient to accommodate one of said missile canisters, said at least one elongated round exhaust gas chimney being adjacent the exterior of said support structure, and extending from near said missile launch end to near said missile exhaust end of said support structure;

a missile exhaust plenum attached to said support structure near said missile exhaust end of said support structure, said missile exhaust plenum being coupled to said at least one elongated round exhaust gas chimney near said missile exhaust end of said support structure, said missile exhaust plenum further including attachment means for attachment to said missile exhaust end of said missile canister, for routing missile exhaust gas from said missile exhaust end of said support structure to said at least one elongated round exhaust gas chimney, for causing missile exhaust gas to vent from said at least one elongated round exhaust gas chimney near said missile launch end of said support structure; and a door structure attached to said missile launch end of said missile launch structure, for, when closed, protecting at least said support structure, said at least one elongated round exhaust gas chimney, and any missile canister accommodated within said cavity, and for, when open, allowing egress of said missile from said missile canister and said exhaust gas from said at least one elongated round exhaust gas chimney.

* * * * *